United States Patent [19]

Cox et al.

[11] 4,229,833

[45] Oct. 28, 1980

[54] WARM-UP SLEEVE

[76] Inventors: William J. Cox, Rte. 1; James A. Hagale, Box 394, both of Ozark, Mo.

[21] Appl. No.: 934,181

[22] Filed: Aug. 16, 1978

[51] Int. Cl.[2] ..... A41D 13/08

[52] U.S. Cl. ..... 2/16

[58] Field of Search ..... 2/16, 59, 125, 126

[56] References Cited

U.S. PATENT DOCUMENTS

| | | | |
|---|---|---|---|
| 1,117,077 | 11/1914 | Mooney | 2/16 |
| 1,561,400 | 11/1925 | Begg | 2/126 |
| 1,796,782 | 3/1931 | Gasperini | 2/16 X |
| 2,045,157 | 6/1936 | Mathias | 2/16 |

FOREIGN PATENT DOCUMENTS

| | | | |
|---|---|---|---|
| 471249 | 2/1951 | Canada | 2/59 |
| 1514611 | 6/1978 | United Kingdom | 2/16 |

*Primary Examiner*—Doris L. Troutman

*Attorney, Agent, or Firm*—Romney, Schaap, Golant, Disner & Ashen

[57] ABSTRACT

A warm-up sleeve to be worn by an athlete engaged in vigorous physical activity such as pitching a baseball or throwing a football. The warm-up sleeve includes a body portion for covering the wearer's arm, a shoulder portion for covering the wearer's shoulder and chest muscles and a strap arrangement for retaining the sleeve in place on the arm of the wearer without interfering with his freedom of movement.

8 Claims, 4 Drawing Figures

Fig. 1.
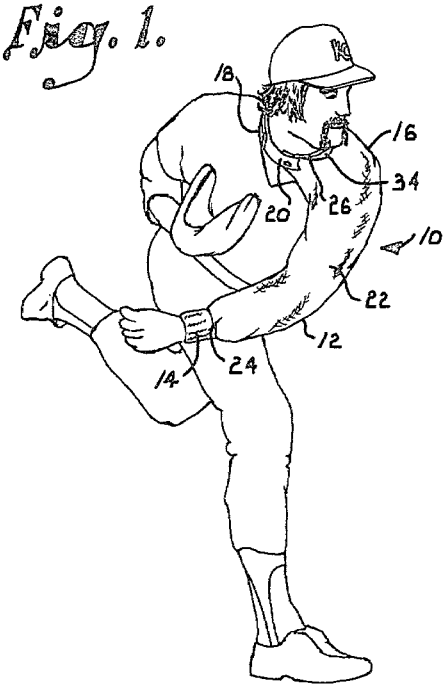
Fig. 2.
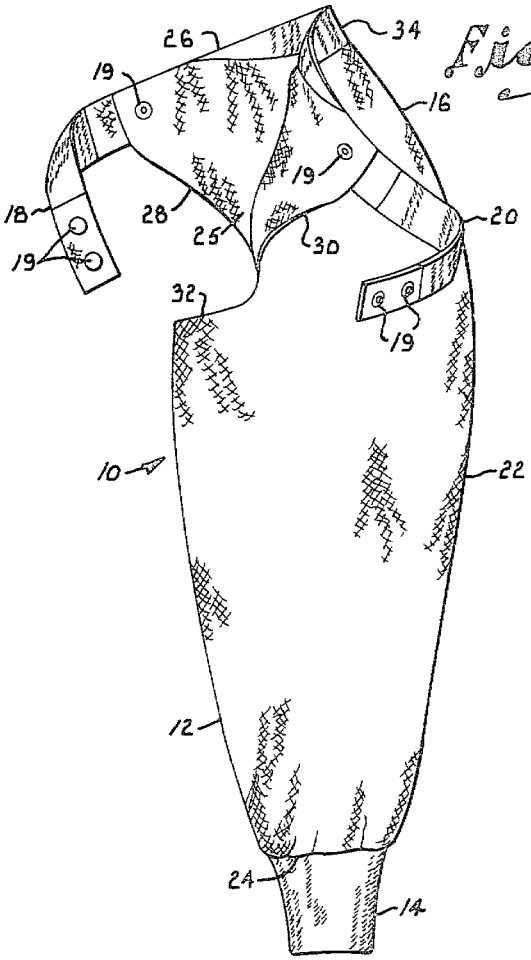
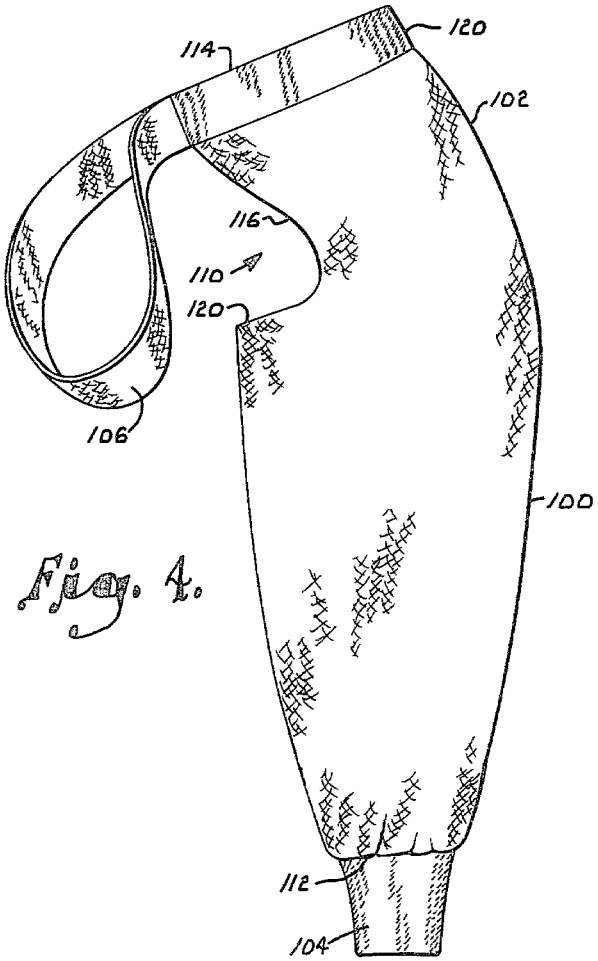
Fig. 4.
Fig. 3.
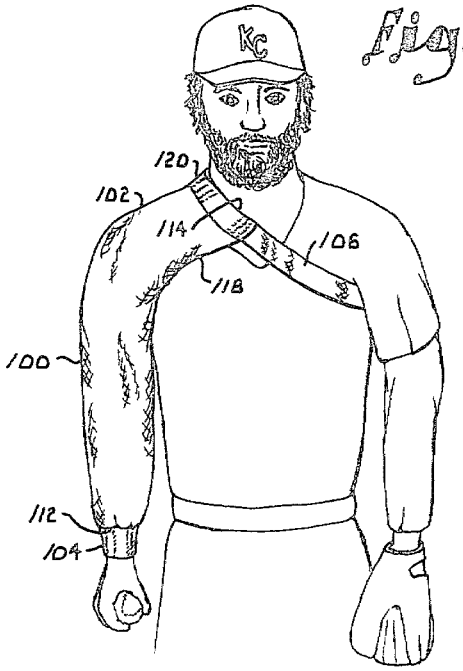

WARM-UP SLEEVE

BACKGROUND AND BRIEF DESCRIPTION OF THE INVENTION

This invention relates in general to a warm-up sleeve suitable for use by an athlete engaged in vigorous physical activity such as pitching a baseball or throwing a football. Additionally when the user is not engaged in physical activity, the sleeve retains body heat in the appropriate area. More particularly, the warm-up sleeve of the present invention includes a unique strap arrangement for keeping the warm-up sleeve in place on the wearer's arm during such physical activity. As will be seen, a strap may be is attached to the warm-up sleeve in the vicinity of the wearer's at chest and shoulder blade and is adjustable under the opposite arm all by use of snaps.

The prior art is replete with various types of sleeve-like items which are specifically designed for a wide range of different purposes. Patents representative of the prior art include the U.S. Pat. to Jones, No. 4,006,495; U.S. Pat. to Girest, No. 3,837,007; U.S. Pat. to Weisberger, No. 2,326,422 and the U.S. Pat. to Riley, No. 1,296,430. Even though the prior art shows a large number of sleeve-like items which are designed for many different uses, none of them specifically deals with a warm-up sleeve to be worn by an athlete engaged in vigorous physical activity. As a result, none of the prior art items employs a securing technique capable of effectively keeping the item in place on the arm of the wearer while he is engaged in vigorous physical activity producing active arm movements.

The most common technique for securing the various sleeve-like items to the arm of the wearer consist of incorporating an elastic band into the upper edge of the item. This band allows the upper edge of the sleevelike item to be peripherally stretchable to allow easy insertion of the wearer's arm into the sleeve. Once the wearer's arm is properly inserted within the sleeve-like item, the elastic band is allowed to contract causing the upper edge of the item to contact the arm of the wearer. It has been found, however, that this type of securing technique is not capable of retaining a sleeve in place on the arm of the wearer during vigorous physical activity such as pitching a baseball or throwing a football. The active arm movement produced by this type of physical activity causes the sleeve-like item to slide down the arm of the wearer because the elastic band cannot be made tight enough to retain the sleeve in place on the arm of the wearer during such physical activity without interfering with the proper circulation of the blood through the arm.

It is therefore an object of the present invention to provide a warm-up sleeve suitable for use by athletes engaged in vigorous physical activity producing active arm movement such as those found pitching a baseball or throwing a football.

Another object of the present invention is to provide a warm-up sleeve of the character described wherein one sleeve is suitable for use by persons of varying sizes.

Another object of the present invention is to provide a warm-up sleeve suitable for use by athletes engaged in vigorous physical activity wherein the sleeve is arranged to be quickly and easily donned and removed.

An additional object of the present invention is to provide a warm-up sleeve of the character described wherein the sleeve is retained in place on the arm of the wearer by means of a unique strap arrangement which does not interfere with the wearer's freedom of movement. In one embodiment of the warm-up sleeve, the strap arrangement is comprised of a pair of holding straps each of which is secured to a different side of the shoulder portion of the sleeve. The free end of one strap may have either a Velcro pile patch or snaps secured to it while the other strap is similarly secured to its free end. These straps are arranged to be releasably secured to each other on the other side of the wearer's neck to retain the sleeve in place on the arm of the wearer. In the second embodiment of the warm-up sleeve, the strap arrangement is comprised of a resilient strap which has its opposite ends connected to different sides of the shoulder portion of the sleeve. In this embodiment of the sleeve, the elastic strap forms a closed loop with the shoulder portion of the sleeve. This loop is arranged to extend around the upper portion of the shoulder corresponding to the arm on which the sleeve is placed and the underarm area of the wearer's other arm. The elastic strap rests against the underarm area of the wearer's other arm to retain the warm-up sleeve in place on the arm of the wearer.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith and in which like reference numerals are employed to indicate like parts in the various views:

FIG. 1 is a perspective view of a first embodiment of the warm-up sleeve of the present invention shown in operable relationship on the arm of a wearer;

FIG. 2 is a front elevational view of the first embodiment of the warm-up sleeve of the present invention;

FIG. 3 is a perspective view of a second embodiment of the warm-up sleeve of the present invention showing the warm-up sleeve in operable relationship on the arm of a wearer; and FIG. 4 is a front elevational view of the second embodiment of the warm-up sleeve of the present invention.

A first embodiment of the warm-up sleeve is shown in FIGS. 1 and 2. The warm-up sleeve, which is generally designated by the numeral 10, includes a body portion 12 for covering an arm of the wearer and a shoulder portion 16 for covering the corresponding shoulder of the wearer. The warm-up sleeve also includes a cuffed portion 14 and a pair of holding straps 18 and 20.

The body and shoulder portions of the warm-up sleeve are integrally formed from a single piece of cloth which has its lateral edges secured together by a seam (not shown) running along the upper surface 22 of the warm-up sleeve. The cloth material used to construct the body and shoulder portions of the warm-up sleeve is of a flexible nature and is capable of insulating the arm of the wearer.

The body portion 12 of the warm-up sleeve is generally cylindrical in shape and has a lower wrist opening defined by the lower edge 24 of the body portion of the sleeve. The shoulder and body portion of the warm-up sleeve are arranged to form an upper arm opening 25 which is defined by the outer edge 26 of the shoulder portion of the warm-up sleeve, the lateral edges 28 and 30 of the shoulder portion of the warm-up sleeve and the underarm edge 32 of the body portion of the warm-up sleeve. The outer edge of the shoulder portion of the warm-up sleeve is constructed of a resilient cloth material band 34 which is arranged to conform to the shoulder of the wearer. The underarm edge 32 is shirred and has an elastic band sewn or otherwise attached to it to tightly hold this part of the sleeve against the arm of the wearer.

The cuff portion of the warm-up sleeve is sewn or otherwise attached to the body portion of the sleeve at the lower edge 24 thereof. The cuff portion of the sleeve is constructed out of an elastic material which is peripherally stretchable to allow the hand of the wearer to be inserted through it. Once the warm-up sleeve is in place on the arm of the wearer, the cuff portion of the sleeve contracts to thereby snugly engage the wrist or lower arm of the wearer to anchor the lower part of the sleeve at this point.

Holding straps 18 and 20 are sewn or otherwise attached by snaps 19 to each other and to the resilient band 34 which forms the outer edge 26 of the shoulder portion of the warm-up sleeve.

To use the warm-up sleeve of the present invention, the wearer initially inserts his arm into the warm-up sleeve causing the distal end of his arm to project through the cuff portion of the sleeve. Once the warm-up sleeve is properly in place on the arm of the wearer, the free end of holding straps 18 and 20 are secured to each other on the other side of the wearer's neck by bringing the male snap fastener or Velcro hook patch on strap 20 into contact with the female snap fastener or Velcro pile patch on strap 18. Once these straps are secured to each other, they encircle the neck of the wearer to retain the warm-up sleeve of the present invention in place on the wearer's arm without interfering with his freedom of movement.

A second embodiment of the warm-up sleeve is shown in FIGS. 3 and 4. The warm-up sleeve shown in these figures includes a generally cylindrical body portion 100 and a shoulder portion 102 which is integrally formed therewith. It also includes a cuff portion 104 and a single securing strap 106. The warm-up sleeve shown in this embodiment of the invention is exactly the same as the one shown in FIGS. 1 and 2 with the exception that holding straps 18 and 20 are replaced by a single securing strap 106. This strap may be attached by snaps (such as snaps 19 of FIG. 2) to the sleeve and has snap adjustment (not shown) for use under the opposite arm.

The body portion of the warm-up sleeve has a wrist opening at the lower portion thereof and an upper arm opening 110 in the upper portion thereof. The wrist opening is defined by the lower edge 112 of the body portion of the sleeve while the upper arm opening is defined by the outer edge 114 of the shoulder portion of the warm-up sleeve, the lateral edges 116 and 118 of the shoulder portion of the sleeve and the underarm edge 120 of the body portion of the warm-up sleeve. The outer edge of the shoulder portion of the sleeve is constructed of a resilient band 120 of cloth material which is capable of conforming to the shoulder of the wearer. The underarm edge is shirred and has an elastic band attached to it to hold this edge of the sleeve tight against the arm of the wearer.

As in the first embodiment of the invention, the cuff portion of the warm-up sleeve is sewn or otherwise attached to the body portion of the sleeve along the lower edge 112 thereof. The cuff portion of the sleeve is constructed of an elastic material which is peripherally stretchable.

Holding strap 106 is constructed of an elastic material and is sewn or otherwise attached (e.g., by snaps) to the resilient band 120 which forms the outer edge of the shoulder portion of the sleeve. Each end of the holding strap is secured to a different lateral edge of the shoulder portion of the sleeve such that the strap forms a closed loop with adjustment snaps (not shown) in the center of the loop and with the band constituting the outer edge of the shoulder portion of the sleeve.

In using this embodiment of the warm-up sleeve, the wearer slips the sleeve over his arm so that the distal end of his arm projects through the cuff portion of the sleeve. The warm-up sleeve is then adjusted so that the body portion of the sleeve encloses the arm of the wearer and the shoulder portion of the sleeve covers the corresponding shoulder of the wearer. Once the warm-up sleeve is in place on the arm of the wearer, the person wearing the sleeve then fastens the snaps under the opposite arm or slips his head and arm through the loop formed by the holding strap 106 and the outer edge of the shoulder portion of the sleeve. The holding strap is then positioned such that it rests against the underarm area of the wearer's other arm. In this way, the warm-up sleeve is retained in place on the arm of the wearer without interfering with his freedom of movement.

From the foregoing, it will be seen that this invention is one well adapted to attain all ends and objects herinabove set forth together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described our invention, we claim:

1. A warm-up sleeve, adapted to be worn on one arm of a wearer, said warm-up sleeve comprising:

a body portion arranged to cover at least a portion of said arm, said body portion being of a generally cylindrical shape and having a wrist opening at the lower edge thereof;

a peripherally stretchable cuff portion attached to said body portion lower edge for snugly engaging the lower edge of said body portion against the wrist or lower arm of said wearer;

a shoulder covering portion arranged to cover at least a portion of the shoulder corresponding with said arm, said shoulder covering portion being defined by an outer edge and first and second lateral edges, said shoulder covering portion being integrally formed with said body portion to define, in conjunction with a shirred underarm edge of said body portion, an upper arm opening;

elastic means attached to said underarm edge for holding the shoulder covering portion tightly against the wearer; and a resilient holding strap having one end attached to said first lateral edge and the other end attached to said second lateral edge adapted to loop under and to rest against the underarm area of the other arm of the wearer;

thereby providing a warm-up sleeve for the wearer's arm which may be securely retained in place and which may conform to and tightly engage the wearer's body in the vicinity of his shoulder and wrist.

2. A warm-up sleeve adapted to be worn on one arm of a wearer, said warm-up sleeve comprising:

a body portion arranged to cover at least a portion of said arm, said body portion being of a generally cylindrical shape and having a wrist opening at the lower edge thereof;

a peripherally stretchable cuff portion attached to said body portion lower edge for snugly engaging the lower edge of said body portion against the wrist or lower arm of said wearer;

a shoulder covering portion arranged to cover at least a portion of the shoulder corresponding with said arm, said shoulder covering portion being defined by an outer edge and first and second lateral edges, said shoulder covering portion being integrally formed with said body portion to define, in conjunction with a shirred underarm edge of said body portion, an upper arm opening;

elastic means attached to said underarm edge for holding the shoulder covering portion tightly against the wearer;

a first holding strap attached to said first lateral edge;

a second holding strap attached to said lateral edge; and means for releasably securing the unattached ends of said first and second holding straps to each other, said holding straps being adapted to loop under and to rest against the underarm area of the other arm of the wearer;

thereby providing a warm-up sleeve for the wearer's arm which may be securely retained in place and which may conform to and tightly engage the wearer's body in the vicinity of his shoulder and wrist.

3. The warm-up sleeve of claim 1, wherein said body portion and said shoulder covering portion are made from a cloth material of a flexible nature and capable of insulating the arm of the wearer.

4. The warm-up sleeve of claim 3, wherein said holding strap is attached to said lateral edges by means of snaps.

5. The warm-up sleeve of claim 4, wherein said holding strap is provided with adjustment snaps in the vicinity of the center of the loop formed by said strap when in place on said wearer's body.

6. The warm-up sleeve of claim 2, wherein said body portion and said shoulder covering portion are made from a cloth material of a flexible nature and capable of insulating the arm of the wearer.

7. The warm-up sleeve of claim 6, wherein said holding straps are attached to said lateral edges by means of snaps.

8. The warm-up sleeve of claim 7, wherein at least one of said straps is provided with adjustment snaps.

* * * * *